US008517870B2

(12) United States Patent
Crowley et al.

(10) Patent No.: US 8,517,870 B2
(45) Date of Patent: Aug. 27, 2013

(54) ELECTRONIC COMPONENT ENCLOSURE FOR AN INFLATED OBJECT

(75) Inventors: Michael J. Crowley, Attleboro, MA (US); Michael Maziarz, Wilbraham, MA (US); Kevin King, Columbus, OH (US)

(73) Assignee: InfoMotion Sports Technologies, Inc., Attleboro, MA (US)

( * ) Notice: Subject to any disclaimer, the term of this patent is extended or adjusted under 35 U.S.C. 154(b) by 281 days.

(21) Appl. No.: 12/876,790

(22) Filed: Sep. 7, 2010

(65) Prior Publication Data

US 2012/0058845 A1 Mar. 8, 2012

(51) Int. Cl.
*A63B 43/00* (2006.01)

(52) U.S. Cl.
USPC ..... 473/570

(58) Field of Classification Search
USPC ..... 473/570, 571, 594, 595, 610
See application file for complete search history.

(56) References Cited

U.S. PATENT DOCUMENTS

| | | | | |
|---|---|---|---|---|
| 4,479,649 | A * | 10/1984 | Newcomb et al. | 473/570 |
| 4,577,865 | A * | 3/1986 | Shishido | 473/570 |
| 4,595,200 | A * | 6/1986 | Shishido | 473/570 |
| 4,776,589 | A * | 10/1988 | Yang | 473/570 |
| 5,102,131 | A * | 4/1992 | Remington | 473/570 |
| 5,236,383 | A * | 8/1993 | Connelly | 473/570 |
| 5,609,411 | A * | 3/1997 | Wang | 473/570 |
| 5,779,576 | A * | 7/1998 | Smith et al. | 473/570 |
| 5,810,685 | A | 9/1998 | Willner et al. | |
| 6,148,271 | A | 11/2000 | Marinelli | |
| 6,196,932 | B1 | 3/2001 | Marsh et al. | |
| 6,251,035 | B1 * | 6/2001 | Fa | 473/570 |
| 6,565,449 | B2 | 5/2003 | Buhler | |
| 6,582,330 | B1 | 6/2003 | Rehkemper et al. | |
| 6,671,390 | B1 | 12/2003 | Barbour et al. | |
| 6,744,375 | B1 | 6/2004 | Groos | |
| 6,757,572 | B1 | 6/2004 | Forest | |
| 6,856,934 | B2 | 2/2005 | Vock et al. | |
| 7,014,581 | B2 * | 3/2006 | Ng | 473/570 |
| 7,021,140 | B2 | 4/2006 | Perkins | |
| 7,072,789 | B2 | 7/2006 | Vock et al. | |
| 7,092,846 | B2 | 8/2006 | Vock et al. | |
| 7,162,392 | B2 | 1/2007 | Vock et al. | |
| 7,192,387 | B2 | 3/2007 | Mendel | |

(Continued)

FOREIGN PATENT DOCUMENTS

| | | |
|---|---|---|
| JP | 2007-014671 | 1/2007 |
| KR | 10-1988-0001317 | 4/1988 |

(Continued)

OTHER PUBLICATIONS

"Built-in Speed Sensor Records How Fast You Throw The Ball—Used As A Training Aid For Pitchers," Markwort Sporting Goods Company [online], [retrieved on May 22, 2012] Retrieved from the Internet:<URL: http://www.markwort.com/featured/speedsensor.asp>.

(Continued)

*Primary Examiner* — Steven Wong
(74) *Attorney, Agent, or Firm* — Fish & Richardson P.C.

(57) ABSTRACT

This document provides methods and materials for securely retaining electronic components within an inflatable object. For example, basketballs having a boot structure for securely retaining one or more electronic components (e.g., a sensor and/or a battery) within the basketball are provided.

18 Claims, 8 Drawing Sheets

(56) References Cited

U.S. PATENT DOCUMENTS

| | | | | |
|---|---|---|---|---|
| 7,234,351 | B2 | 6/2007 | Perkins | |
| 7,273,431 | B2 | 9/2007 | DeVall | |
| 7,308,818 | B2 | 12/2007 | Considine et al. | |
| 7,625,314 | B2 | 12/2009 | Ungari et al. | |
| 7,643,895 | B2 | 1/2010 | Gupta et al. | |
| 7,891,666 | B2 | 2/2011 | Kuenzler et al. | |
| 8,070,654 | B2 | 12/2011 | Chapa, Jr. et al. | |
| 8,078,478 | B2 | 12/2011 | Fleming et al. | |
| 8,083,646 | B2 | 12/2011 | Chapa, Jr. et al. | |
| 8,086,421 | B2 | 12/2011 | Case, Jr. et al. | |
| 8,109,858 | B2 | 2/2012 | Redmann | |
| 8,112,251 | B2 | 2/2012 | Case, Jr. et al. | |
| 8,128,410 | B2 | 3/2012 | Prstojevich | |
| 8,152,695 | B2 | 4/2012 | Riley et al. | |
| 8,172,722 | B2 | 5/2012 | Molyneux et al. | |
| 8,206,219 | B2 | 6/2012 | Shum et al. | |
| 8,231,487 | B2 * | 7/2012 | Nurnberg et al. | 473/570 |
| 8,231,506 | B2 | 7/2012 | Molyneux et al. | |
| 2003/0207718 | A1 | 11/2003 | Perlmutter | |
| 2003/0224885 | A1 * | 12/2003 | Leal et al. | 473/570 |
| 2005/0069853 | A1 | 3/2005 | Tyson et al. | |
| 2005/0288133 | A1 * | 12/2005 | Rudell | 473/569 |
| 2006/0025282 | A1 | 2/2006 | Redmann | |
| 2006/0135297 | A1 * | 6/2006 | Cruciani | 473/570 |
| 2006/0148594 | A1 | 7/2006 | Saintoyant et al. | |
| 2007/0021244 | A1 * | 1/2007 | Ko | 473/570 |
| 2007/0026975 | A1 | 2/2007 | Marty et al. | |
| 2007/0281811 | A1 * | 12/2007 | Wang | 473/570 |
| 2008/0015064 | A1 | 1/2008 | Webb et al. | |
| 2008/0026877 | A1 | 1/2008 | Neel | |
| 2009/0029754 | A1 | 1/2009 | Slocum et al. | |
| 2009/0047645 | A1 | 2/2009 | Dibenedetto et al. | |
| 2009/0048044 | A1 * | 2/2009 | Oleson et al. | 473/570 |
| 2009/0048070 | A1 | 2/2009 | Vincent et al. | |
| 2009/0210078 | A1 | 8/2009 | Crowley | |
| 2009/0298650 | A1 | 12/2009 | Kutliroff | |
| 2009/0325739 | A1 | 12/2009 | Gold | |
| 2010/0048302 | A1 | 2/2010 | Lutnick et al. | |
| 2010/0053324 | A1 | 3/2010 | Kim et al. | |
| 2010/0069181 | A1 * | 3/2010 | Lin | 473/570 |
| 2010/0105480 | A1 | 4/2010 | Mikhailov et al. | |
| 2010/0130315 | A1 * | 5/2010 | Steidle | 473/570 |
| 2010/0184563 | A1 | 7/2010 | Molyeux et al. | |
| 2011/0077112 | A1 * | 3/2011 | Erario et al. | 473/570 |
| 2011/0118062 | A1 * | 5/2011 | Krysiak et al. | 473/570 |
| 2012/0029666 | A1 | 2/2012 | Crowley | |
| 2012/0129138 | A1 | 5/2012 | Redmann | |
| 2012/0231906 | A1 * | 9/2012 | Barry et al. | 473/570 |
| 2013/0079906 | A1 | 3/2013 | Crowley et al. | |

FOREIGN PATENT DOCUMENTS

| | | |
|---|---|---|
| KR | 2000055834 | 9/2000 |
| KR | 2001008367 | 2/2001 |
| WO | WO/95/34351 | 12/1995 |
| WO | WO 2009/102813 | 8/2009 |
| WO | WO/2010/111705 | 9/2010 |

OTHER PUBLICATIONS

"Intelligent Basketball Tracks Trajectory," Freescale [online] [retrieved on May 23, 2012]. Retrieved from the Internet: <URL: http://www.freescale.com/webapp/sps/site/overview.jsp?code=CASE_STUDY_INTELLIGENT_BASKETBALL>, 2 pages.

"Speed Sensor™ Programmable Balls," Markwort [online], [retrieved on May 25, 2012]. Retrieved from the Internet: <URL: http://www.markwort.com/featured_tab/speedsensor_big.asp>, 2 pages.

Murray, "Freescale Rolls Out World's First Intelligent Basketball," Design News Blog, Jun. 29, 2007 [retrieved May 22, 2012] Retrieved from the Internet:<URL: http://www.designnews.com/author.asp?section_id=1386&doc_id=215078&print=yes>.

U.S. Appl. No. 61/028,823, filed Feb. 14, 2008, Crowley.

U.S. Appl. No. 61/164,277, filed Mar. 27, 2009, Crowley.

U.S. Appl. No. 61/249,526, filed Oct. 7, 2009, Crowley.

Authorized Officer D. Kim, International Search Report and Written Opinion for PCT/US2010/029068, mailed Oct. 21, 2010, 13 pages.

Authorized Officer RA Kwang Pyo, International Search Report/Written Opinion in PCT/US2009/033831 mailed Sep. 24, 2009, 11 pages.

Authorized Officer S. Baharlou, International Preliminary Report on Patentability for PCT/US2010/029068, mailed Oct. 6, 2011, 9 pages.

Authorized Officer Y. Cussac, International Preliminary Report on Patentability in PCT/US2009/033831, mailed Aug. 26, 2010, 6 pages.

International Search Report and Written Opinion in International Application No. PCT/US2011/050498, mailed Apr. 25, 2012, 9 pages.

International Preliminary Report on Patentability in International Application No. PCT/US2011/050498, mailed Mar. 12, 2013, 6 pages.

Hsu, Michael. "Gear & Gadgets: Making Sense of Your Swing, Turn Your Golf Glove Into a High-Tech Coach." The Wall Street Journal, Aug. 4-5, 2012. (1 page).

* cited by examiner

ELECTRONIC COMPONENT ENCLOSURE FOR AN INFLATED OBJECT

TECHNICAL FIELD

This document relates to an enclosure for securely retaining electronic components.

BACKGROUND

The sport of basketball has increased in popularity immensely since its inception in the late 1800s. Basketball is played the world over by players at varying degrees of skill level, from professionals, to college and high school athletes, to recreational players of all ages. Basketball incorporates various maneuvers and skills that require varying degrees of muscle control and hand-eye coordination. A variety of techniques are used by coaches and trainers in order to improve muscle control and hand-eye coordination of players in order to improve the ball handling and shooting skills of the players.

SUMMARY

This document provides methods and materials for securely retaining electronic components within an inflatable object. For example, this document provides basketballs having a boot structure for securely retaining one or more electronic components (e.g., a sensor and/or battery) within the basketball.

In general, one aspect of this document features an inflatable object comprising, or consisting essentially of, (a) an inner compartment to be inflated with air, and (b) a pocket compartment defining an inner cavity configured to house an electronic component, wherein air inflated into the inner compartment is isolated from the inner cavity of the pocket compartment. The inner cavity can be open to external air. At least a portion of the pocket compartment can be flexible such that inflation of the inner compartment with air causes the portion of the pocket compartment to flex. At least a portion of the pocket compartment can be flexible such that inflation of the inner compartment with air causes the portion of the pocket compartment to flex, and wherein, when the inner cavity contains the electronic component, the flexed portion of the pocket compartment can increase a compression force against the electronic component, thereby reducing the possibility that the electronic component moves within the inner cavity relative to the pocket compartment. The pocket compartment can be flexible. Inflation of the inner compartment with air can cause the flexible pocket compartment to compress against the electronic component when the inner cavity contains the electronic component. Inflation of the inner compartment with air can cause the flexible pocket compartment to stiffen, thereby reducing vibrational noise. The inflatable object can be a basketball, soccer ball, volleyball, or football. The pocket compartment can comprise a body portion having flexible walls configured to exert an inward pressure directly on the electrical component, when the inner compartment is inflated and when the electrical component is present within the inner cavity. The pocket compartment can comprise a body portion having flexible walls configured to exert an inward pressure indirectly on the electrical component, when the inner compartment is inflated and when the electrical component is present within the inner cavity. The pocket compartment can comprise a removable cap. The removable cap can define a hole. The removable cap can define a hole to provide the inner cavity with an opening to external air. The electronic component can be a circuit board comprising at least one motion sensor. The inflatable object can comprise a battery and a motion sensor located within the inner cavity. The inner cavity can be open to external air pressure without compromising the pressure of the inner compartment.

In another aspect, this document features an inflatable basketball comprising, or consisting essentially of, (a) an inner compartment to be inflated with air, and (b) a pocket compartment defining an inner cavity configured to house an electronic component, wherein air inflated into the inner compartment is isolated from the inner cavity of the pocket compartment, and wherein at least a portion of the pocket compartment is flexible such that inflation of the inner compartment with air causes the portion of the pocket compartment to flex. Inflation of the inner compartment with air can cause the portion of the pocket compartment to compress against the electronic component when the inner cavity contains the electronic component. Inflation of the inner compartment with air can cause the portion of the pocket compartment to stiffen, thereby reducing vibrational noise.

In another aspect, this document features an inflatable object comprising, or consisting essentially of, (a) an inner bladder configured to be inflated with air, (b) an outer layer configured to form at least a portion of the outer surface of the inflatable object, and (c) a housing comprising an inner compartment configured to house an electronic component, wherein air inflated into the inner bladder is isolated from the inner compartment of the housing. The housing can comprise an outer wall, wherein the outer wall can be integral with at least a portion of the inner bladder. Inflation of the inner bladder with air can cause the housing to compress against the electronic component when the inner compartment contains the electronic component. Inflation of the inner compartment with air can cause the housing to stiffen, thereby reducing vibrational noise. At least a portion of the housing can be flexible, wherein inflation of the inner bladder with the air can increase the pressure applied by the inner bladder against the housing, and wherein the increased pressure applied against the housing can increase the pressure applied against the electronic component when the electronic component is present within the inner compartment.

In another aspect, this document features an inflatable basketball comprising, or consisting essentially of, (a) an inner bladder configured to be inflated with air, (b) an outer layer configured to form at least a portion of the outer surface of the basketball, (c) a housing comprising an inner compartment configured to house a removable motion sensor and a removable battery, wherein air inflated into the inner bladder is isolated from the inner compartment of the housing, and (d) a removable cap configured to engage the housing, wherein the removable cap defines an opening such that air is capable of flowing from the inner compartment to the external environment outside of the inflatable basketball, and wherein the opening is configured to provide access of a battery charging input to the removable battery without removing the cap. The outer wall can be integral with at least a portion of the inner bladder. Inflation of the inner bladder with air can cause the housing to compress against the electronic component when the inner compartment contains the electronic component. Inflation of the inner compartment with air can cause the housing to stiffen, thereby reducing vibrational noise. At least a portion of the housing can be flexible, wherein inflation of the inner bladder with the air can increase the pressure applied by the inner bladder against the housing, and wherein the increased pressure applied against the housing can increase the pressure applied against the removable motion sensor when the removable motion sensor is present within the inner compartment.

These and other embodiments described herein may provide one or more of the following benefits. Electronic components can be securely retained within an inflated object. The accuracy of motion data recorded by sensors retained within an enclosure can be improved by reducing vibrational noise detected by the sensors. A sensor enclosure can be securely affixed to an inflated object. Pressure from an inner bladder of an inflated object can be imparted upon an enclosure to more securely retain electronic components retained within the enclosure.

In some cases, a compressible enclosure provided herein can be configured to maximize the ratio of stiffness to weight, thereby allowing the enclosure to be light weight while providing a required level of stiffness to secure one or more sensors and attenuate possible vibrations generated during typical use (e.g., typical basketball use). The electronics can be easily installed into the enclosure when the inflatable object (e.g., basketball) is deflated, and then the addition of air pressure can secure the electronics in place. In some cases, the installation of the electronics does not impact the integrity of the inflatable's seal. The compressibility of the enclosure can be designed so that the enclosure stiffness increases with the addition of air pressure. In some cases, the methods and materials provided herein can provide for quick sensor insertion, increased sensor stability inside the inflatable object, reduced extraneous vibrational noise that can impact measurements, and the ability to remove the sensor in the future.

Unless otherwise defined, all technical and scientific terms used herein have the same meaning as commonly understood by one of ordinary skill in the art to which this invention pertains. Although methods and materials similar or equivalent to those described herein can be used in the practice or testing of the present invention, suitable methods and materials are described below. All publications, patent applications, patents, and other references mentioned herein are incorporated by reference in their entirety. In case of conflict, the present specification, including definitions, will control. In addition, the materials, methods, and examples are illustrative only and not intended to be limiting.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

This document provides methods and materials for securely retaining electronic components within an inflatable object. For example, this document provides inflatable objects (e.g., inflatable balls such as basketballs, soccer balls, volleyballs, and footballs) having a boot structure or enclosure for securely retaining one or more electronic components (e.g., a sensor and/or battery) within the inflatable object. As described herein, the boot structure or enclosure can be configured such that an electronic component positioned within the boot structure or enclosure is not within the inner bladder of the inflatable object. For example, an inflatable object such as a basketball can be designed to have a boot structure or enclosure that is configured such that an electronic component positioned within the boot structure or enclosure is within the interior of the basketball, but not within the inner bladder of the basketball. In such cases, the inner bladder is the compartment that is inflated with air. For example, the inner bladder of an inflatable object such as a basketball can receive from about 7 pounds per square inch (psi) to about 9 psi of air pressure. Since the air pressure within the inner bladder of the inflatable object can be between about 7 and about 9 psi and the electronic components positioned within the boot structure or enclosure can be located outside of the inner bladder of a basketball, the air pressure to which the electronic components are exposed can be essentially atmospheric air pressure. In some cases, the electronic components can be open to or in contact with outside air, as opposed to the pressurized air within an inner bladder of an inflatable object.

As an inner bladder of an inflatable object is inflated with increasing air pressure, one or more wall components of the boot structure or enclosure can be deformed or compressed such that those one or more wall components directly press against one or more electronic components within the boot structure or enclosure, thereby securely retaining or positioning the electronic components. In some cases, the one or more wall components can press against one or more other structures (e.g., a foam insert) that directly presses against the one or more electronic components within the boot structure or enclosure, thereby securely retaining or positioning the electronic components. In some cases, deformable wall components can compress leading to an increased stiffness of the overall system (e.g., boot, electronics, and inner bladder).

Figure 1:
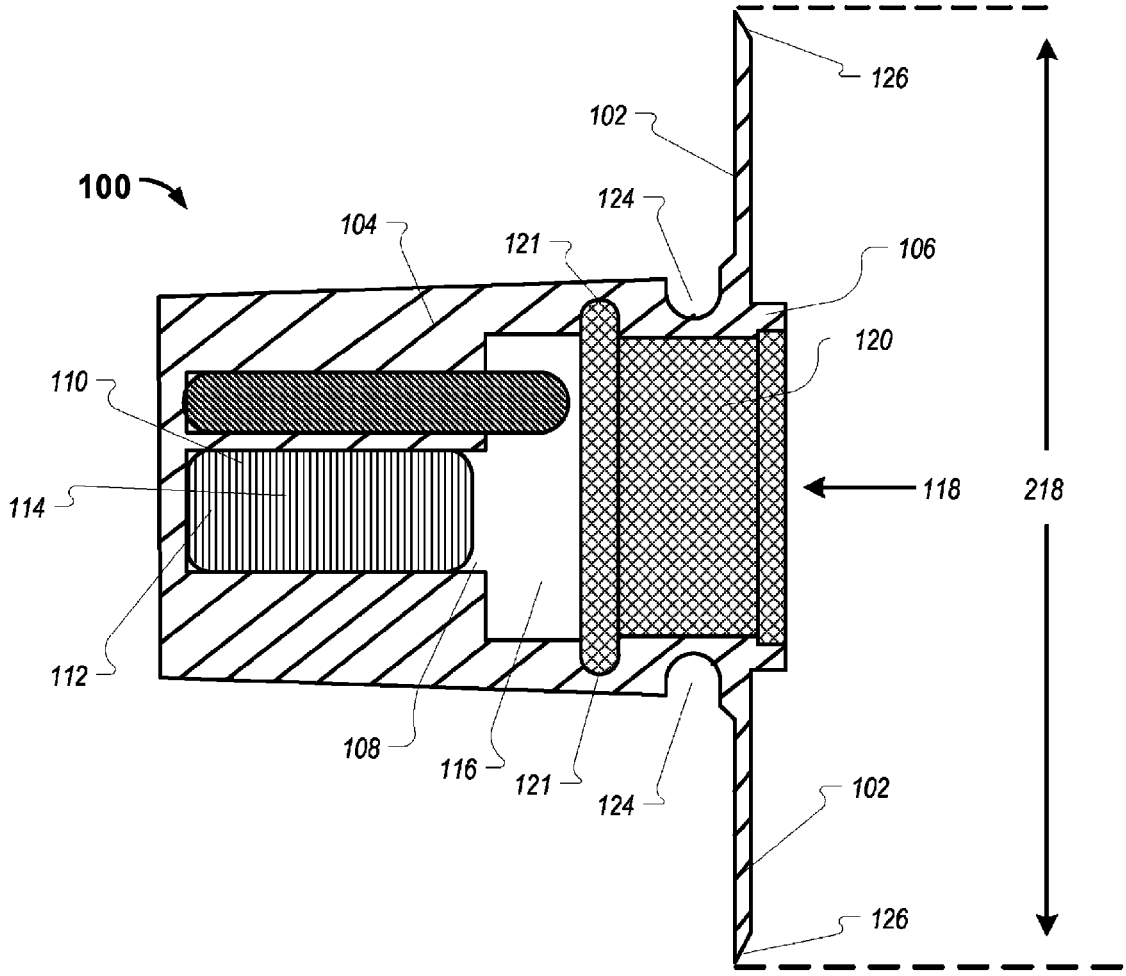
FIG. 1 is a cross sectional view of an enclosure or a boot structure for securely retaining electronic components with respect to an inflated object.

Referring to FIG. 1, a sensor enclosure 100 can be used to retain or position various electronic components. In some cases, sensor enclosure 100 can be integral with an inner bladder of an inflatable object, integral with the outer skin of an inflatable object, or can be configured to securely affix to an inflatable object. Examples of inflatable objects that can be used in conjunction with sensor enclosure 100 include, without limitation, basketballs, volleyballs, footballs, soccer balls, and inflatable punching bags. For example, sensor enclosure 100 can be integrated into or attached to a standard full-size basketball having an inflated circumference of about 29.5 inches. As another example, sensor enclosure 100 can be integrated into or attached to a standard mid-size basketball having an inflated circumference of 28.5 inches. The electronic components retained or secured in position by sensor enclosure 100 can include one or more motion sensors for recording motion data and detecting motions of an inflated object to which sensor enclosure 100 is a part of. The motion data collected by the sensors can be used to evaluate various athletic skills and abilities, such as basketball handling skills, dribbling skills, and shooting skills, that can be used to asses the skill level of a player and help to improve that player's skills and abilities.

Sensor enclosure 100 can include an extending lip portion 102 attached to a main body portion 104. As can be more clearly seen in FIGS. 3 and 4, extending lip portion 102 extends around main body portion 104 to form a circle (e.g., a complete circle). In some cases, extending lip portion 102 is molded or vulcanized during manufacture such that it becomes integral with a layer (e.g., an inner bladder layer, or an outer skin layer) of the inflatable object. In some implementations, extending lip portion 102 can extend further in some directions than others (e.g., to form an oval shape). In the example shown in FIGS. 1-4, extending lip portion 102 and main body portion 104 are constructed together from a single piece of materiel. In some implementations, extending lip portion 102 and main body portion 104 are constructed from separate pieces and affixed to one another. Extending lip portion 102 and main body portion 104 can, for example, be constructed from rubber, flexible or semi-flexible plastic, leather, or composite leather (e.g., synthetic leather).

As will be explained in greater detail below, sensor enclosure 100 can affix to or be made integral with a basketball or other inflated object. For example, sensor enclosure 100 can be designed such that all or a portion of extending lip portion 102 becomes integral with the inner bladder. In some cases, the thickness of the inner bladder at the region that includes lip portion 102 can be thicker than the inner bladder at other regions. For example, extending lip portion 102, when integrated into the inner bladder, can increase the thickness of the material of the inner bladder in the region around the sensor enclosure. In some cases, the inner bladder material can form a flush interface with the top surface of the sensor enclosure 100 at, e.g., upper portions 106. When being manufactured, the upper portions 106 can be placed within an opening in an inner bladder. Once inserted, at extending lip portion 102 and upper portions 106 can be treated (e.g., vulcanized) such that the material of extending lip portion 102 and upper portions 106 become integral with the material of the inner bladder.

In some implementations, sensor enclosure 100 can affix to or be made integral with an inflatable object with (or without) the upper portion 106 of sensor enclosure 100 extending above a surface of the inflated object and/or extending lip portion 102, which can form a portion of the outer surface of the inflatable object.

In some cases, upper portion 106 of sensor enclosure 100 and/or the upper surface of cap 120 can be textured to match the texture of the outer surface layer of the inflatable object when upper portion 106 of sensor enclosure 100 and/or the upper surface of a cap 120 of sensor enclosure 100 are configured to be exposed to an outer surface. In some cases, a separate layer of textured material can be placed or affixed to upper portion 106 and/or the upper surface of cap 120 such that the separate layer of textured material matches the texture of the outer surface layer of the inflatable object. Such a separate layer can be designed to have an opening that can be aligned with the opening of cap 120.

Sensor enclosure 100 can define an internal cavity 108 disposed within main body portion 104. Internal cavity 108 can house one or more electronic components, including a battery 110 and one or more circuit boards 112. Battery 110 can supply power to circuit board 112 and other electronic components housed within sensor enclosure 100. Battery 110 can, for example, be a primary battery (e.g., non-rechargable) alkaline, or a rechargeable battery such as a nickel-metal hydride, lithium ion, lithium polymer, or zinc oxide battery. Circuit board 112 can include various electronic components including sensors such as motion sensors (e.g., accelerometers, angular rate gyros, and magnetometers), temperature sensors, and pressure sensors. The sensors can be configured to, for example, record data relating to motions of an inflated object to which sensor enclosure 100 is attached or a part of. For example, the sensors can measure angular velocity, acceleration, linear velocity, and/or deceleration for an inflated object. As another example, the sensors can measure the number of times that a basketball is bounced or contacted within a set time period. As yet another example, the sensors can measure an angle at which an inflated object contacts a surface (e.g., the floor). As yet another example, the sensors can measure a spin rate of a basketball to which sensor enclosure 100 is attached or a part of. As another example, the sensors can measure the frequency and force with which a punching bag is punched or otherwise contacted. As still another example, the sensors can measure the number of times a soccer ball is contacted over a set time period. The sensors can also, for example, measure the spin rate of a spiraling football, the arc of a basketball shot, the spin axis and spin rate of a basketball shot, or the velocity with which a soccer ball is kicked.

Sensor enclosure 100 can include a divider 114 for separating battery 110 from circuit board 112 and for more securely holding battery 110 and circuit board 112 in place. Divider 114 can be made from, for example, rubber, plastic, foam, or another suitable material. In some implementations, the material selected for divider 114 can be suitably shock absorbent so as to retain battery 110 and circuit board 112 in place while absorbing at least part of the force of an impact when an inflated object to which sensor enclosure 100 is attached contacts a surface or other object.

Figure 2:
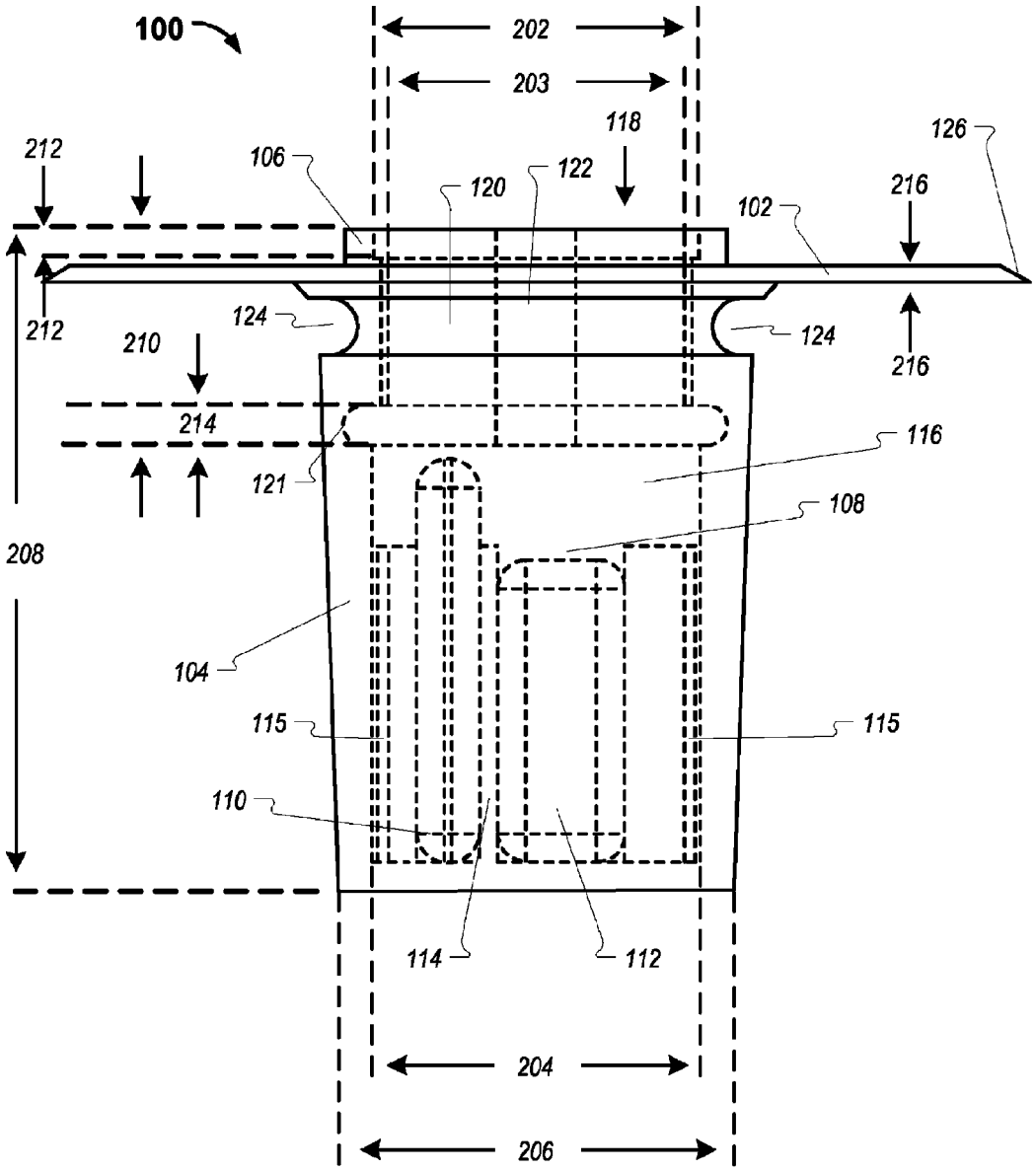
FIG. 2 is a side view of the enclosure of FIG. 1.

Referring to FIG. 2, sensor enclosure 100 can include securing members 115. In some implementations, securing members 115 can be foam, rubber, or another material that is inserted into internal cavity 108 in order to secure battery 110 and circuit board 112 in place. In some implementations, securing members 115 can be constructed in one piece as part of main body portion 104. Like divider 114, the material used to manufacture securing members 115 can be selected so as to be suitably shock absorbent in order to retain battery 110 and circuit board 112 in place while absorbing at least part of the force of an impact when an inflated object to which sensor enclosure 100 is attached contacts a surface or other object. In some implementations, one or more of the securing members, in combination with divider 114, can form compartments within internal cavity 108 for receiving battery 110 and circuit board 112.

Referring again to FIG. 1, internal cavity 108 can include additional space 116 for housing additional wiring, electronic components, or foam packing. For example, additional space 116 can house wires connecting battery 110 to circuit board 112 as well as foam packing for securing battery 110 and circuit board 112 in place within internal cavity 108. In some implementations, the dimensions of internal cavity 108 are customized to provide a snug fit for battery 110 and circuit board 112.

Sensor enclosure 100 further includes an aperture 118 passing through upper portion 106 to internal cavity 108. Aperture 118 can be configured to receive a cap 120. In some cases, cap 120 can be configured to provide a flush or nearly flush surface along an outer surface of the inflatable object. In some cases, cap 120 can assist in ensuring that the components stored within internal cavity 108 remain secured in place while separating internal cavity 108 from an external environment of sensor enclosure 100. Cap 120 can be manufactured, for example, from rubber, plastic, foam, leather, or composite leather. In some cases, cap 120 and internal cavity 108 can be configured to have mating surfaces such that cap 120 is held in place within at least a portion of internal cavity 108. For example, as shown in the examples, cap 120 can have a flared bottom portion in order to more securely retain cap 120 within aperture 118. Sensor enclosure 100 can include a groove 121 for receiving the flared bottom portion of cap 120. Groove 121 can extend in a circle around internal cavity 108. In some cases, the mating surfaces can be switched such that cap 120 contains a groove or other appropriate structure and internal cavity 108 contains a flare or other appropriate structure.

Figure 6:
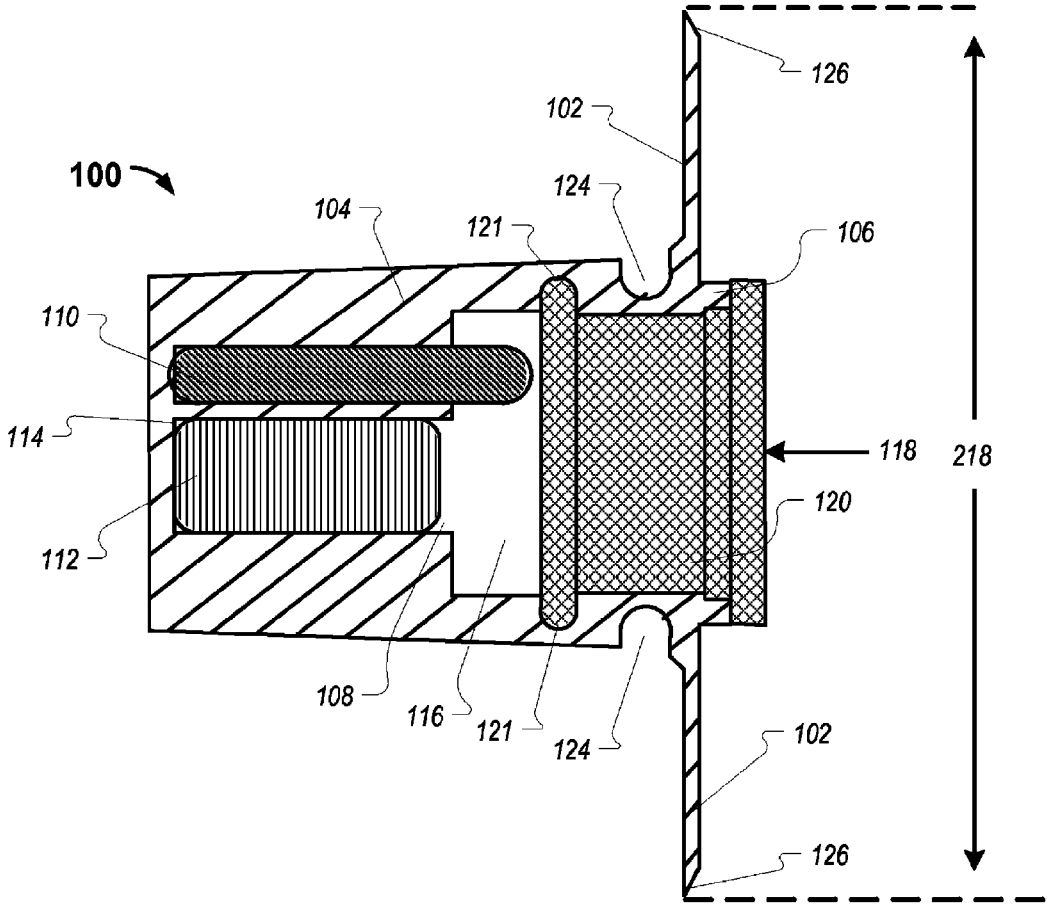
FIG. 6 is a cross sectional view of an enclosure or a boot structure for securely retaining electronic components with respect to an inflated object.
Figure 7:
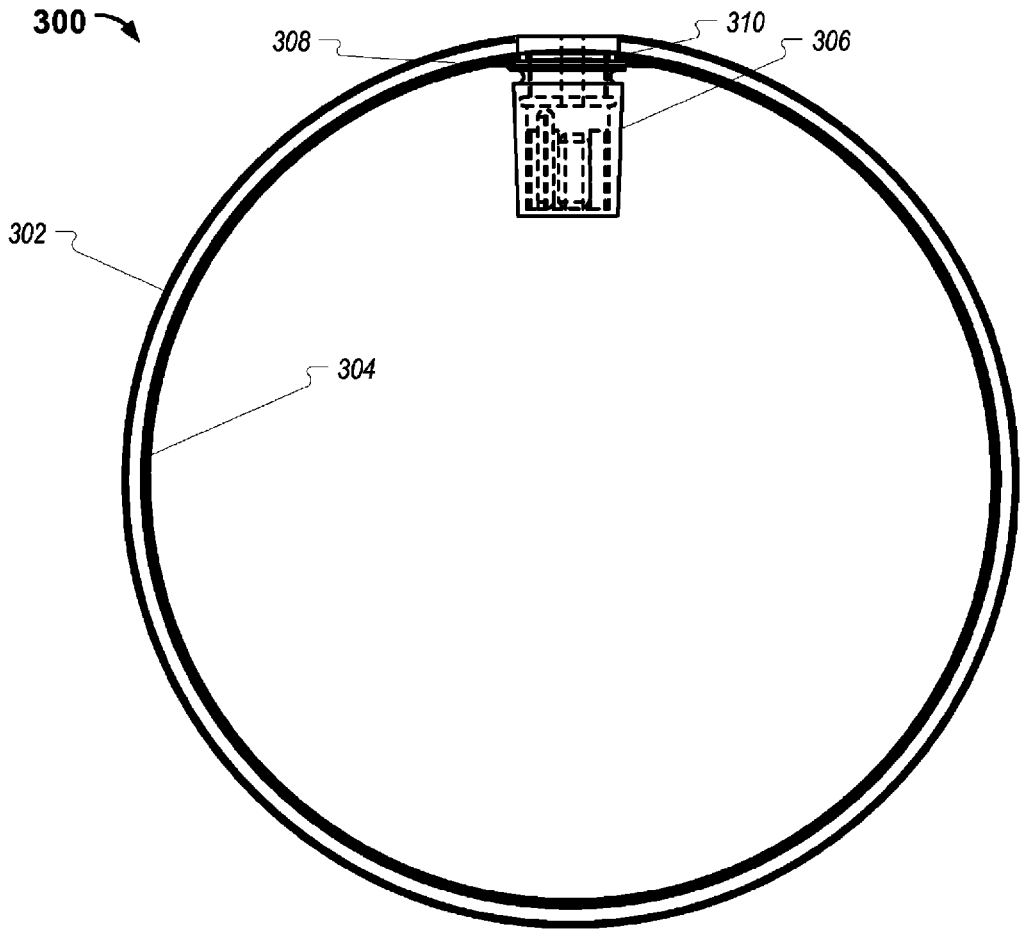
FIG. 7 is a cross sectional view of an inflatable object having an enclosure or a boot structure for securely retaining electronic components.

As can be seen in FIGS. 6 and 7, cap 120 can be configured to extend above an upper surface of enclosure 100 (e.g., above upper portion 106). In such cases, cap 120 can provide a flush or nearly flush surface along an outer surface of the inflatable object.

Figure 4:
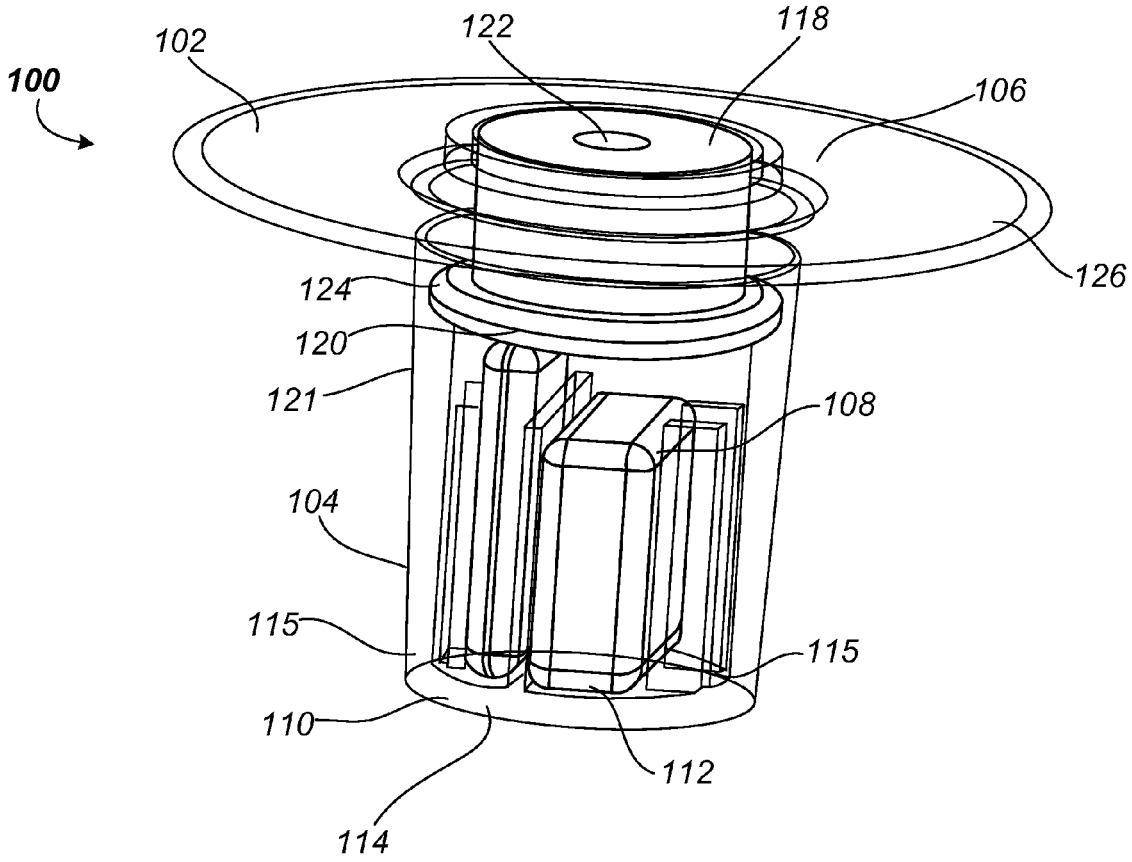
FIG. 4 is a semi-transparent perspective view of the enclosure of FIG. 1.

As can be seen in FIGS. 2 and 4, in some implementations, cap 120 can include an aperture 122 extending there through. Aperture 122 can allow internal cavity 108 to be open to the external environment. In such cases, the air pressure within internal cavity 108 can be essentially the same air pressure as the external environment. In some implementations, cap 120 can be solid and not contain an aperture in order to allow for a pressure differential between internal cavity 108 and the external environment to be created.

Figure 3:
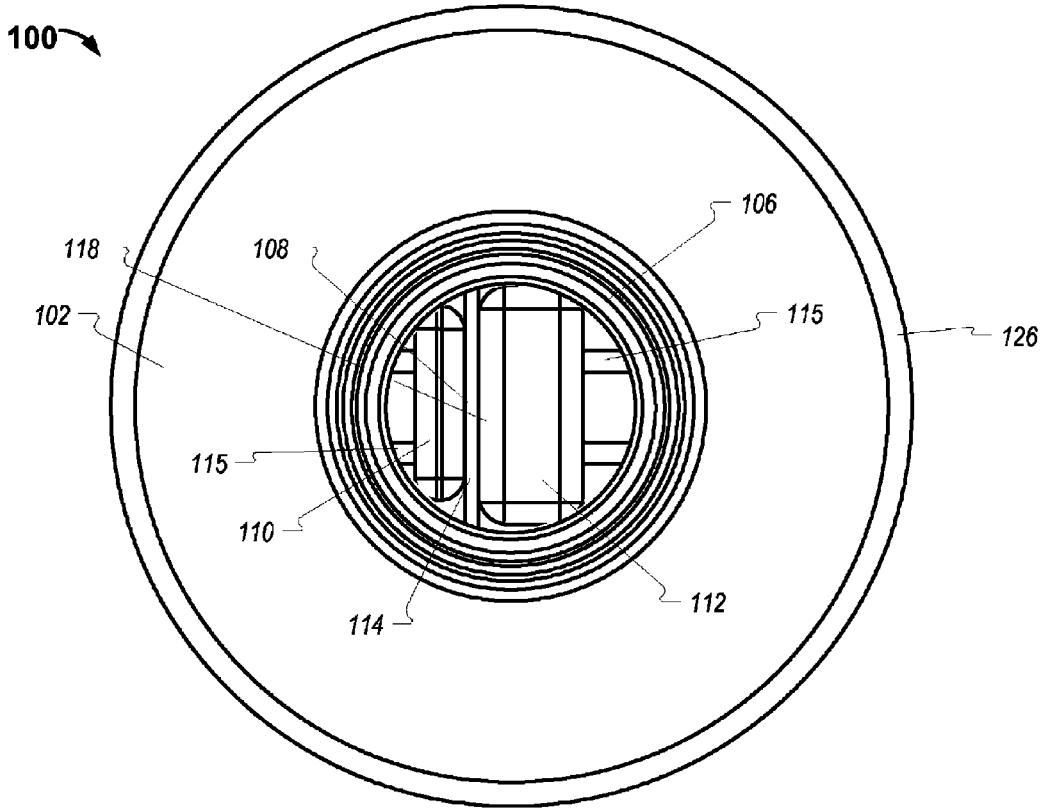
FIG. 3 is a top view of the enclosure of FIG. 1 with a cap portion removed.

Referring to FIG. 3, a top view of sensor enclosure 100 is shown with cap 120 removed to show the arrangement of battery 110, circuit board 112, divider 114, and securing members 115 within internal cavity 108. As can be seen, theses components are arranged within internal cavity 108 to minimize lateral movement of battery 110 and circuit board 112 within sensor enclosure 100.

Referring again to FIG. 1, sensor enclosure 100 can include a groove 124 located beneath extending lip portion 102. In some cases, a sensor enclosure provided herein can lack groove 124. As can be seen in FIG. 4, groove 124 can extend around main body portion 104 of extending lip portion 102 to form a circular groove. Groove 124 can be configured to vibrationally isolate the enclosure from the outer skin of the inflatable object. When the skin of the inflatable object vibrates due to an impact event (e.g., a bounce of a ball against the ground), the skin may resonate. Groove 124 can reduce the transfer of these vibrations to the enclosure, thereby limiting the sensor from sensing these vibrations which are not a signature of the bulk motion of the ball and thereby limiting the ability of the sensor enclosure from absorbing bounce energy from the ball which may decrease the bounce performance of the ball.

In some implementations, sensor enclosure 100 is made integral with an inner bladder of an inflatable object such that extending lip portion 102 is made integral with the inner bladder. In some implementations, an upper surface of extending lip portion 102 can contact an inner surface of an inner bladder of the inflatable object such that upper portion 106 protrudes through an opening in the inner bladder. In some implementations, sensor enclosure 100 is positioned such that the top surfaces of upper portion 106 and cap 120 are flush or nearly flush with an outer surface of the inner bladder. In some implementations, sensor enclosure 100 is positioned such that the top surfaces of upper portion 106 and cap 120 are flush or nearly flush with an outer surface of an outer layer of the inflatable object. In some cases, the material of the inner bladder and the material of extending lip portion 102 can be treated (e.g., vulcanized) to form an integral unit. In some cases, when vulcanized, it is the bottom surface of extending lip portion 102, rather than the top surface of extending lip portion 102, that can mate with the inner bladder and is affixed together.

In some implementations, an upper surface of extending lip portion 102 can contact an inner surface of an outer layer of the inflatable object such that upper portion 106 protrudes through an opening in the outer layer and the top surfaces of upper portion 106 and cap 120 are flush or nearly flush with an outer surface of the outer layer. In some cases, the material of the inner bladder and the material of extending lip portion 102 can be treated (e.g., vulcanized) to form an integral unit. In some cases, the material of the outer layer and the material of extending lip portion 102 can be treated (e.g., vulcanized) to form an integral unit.

In some cases, the bottom of extending lip portion 102 can contact the outer surface of the inner bladder. In some implementations, sensor enclosure 100 is secured to the inflatable object (e.g., basketball) by applying an adhesive to the bottom side of extending lip portion 102 in order to form a seal between extending lip portion 102 and the inner bladder. Examples of adhesives that can be used include, without limitation, rubber cement and two part epoxy. In some cases, the top of extending lip portion 102 contacts an inner surface of the inner bladder. Extending lip portion 102 can be affixed to the inner surface of the inner bladder using an adhesive to form a seal between extending lip portion 102 and the inner bladder.

In some alternative implementations, groove 124 can be configured to accept the edges of an opening in the surface of an inflated object when sensor enclosure 100 is affixed to the inflated object. For example, sensor enclosure 100 can be attached to a basketball by inserting main body portion 104 through an opening in the surface of the basketball. The bottom of extending lip portion 102 can contact the outer portion of the surface of the basketball while the internal surfaces of groove 124 contact the edges of the opening in the surface of the basketball. In some cases, the material of the inflatable object (e.g., basketball) and the material of extending lip portion 102 can be treated (e.g., vulcanized) to form an integral unit. In some cases, when vulcanized, it is the bottom surface of 102 that can mate with the inner bladder and is affixed together.

In some implementations, sensor enclosure 100 is secured to the inflatable object (e.g., basketball) by applying an adhesive to the bottom side of extending lip portion 102 in order to form a seal between extending lip portion 102 and the outer surface of the inflatable object. Examples of adhesives that can be used include, without limitation, rubber cement and two part epoxy.

In some cases, extending lip portion 102 can include a tapered edge 126. Tapered edge 126 can allow the enclosure to better conform to the inside of a spherical surface to which it is attached.

As described above, in some implementations, sensor enclosure 100 can be made integral with an inner bladder of an inflated object. For example, many inflatable objects, such as basketballs, footballs, soccer balls, volley balls, and certain types of punching bags, are manufactured with an outer layer (e.g., leather, rubber, or a synthetic composite) that surrounds an inner bladder (e.g., a rubber bladder). An inflated object is inflated by inserting a needle through a valve disposed through both the outer layer and the inner bladder and pumping air into the inner bladder in order to pressurize the inside environment of the inflated object. For example, basketballs can generally be inflated such that the internal pressure is between 7 and 9 psi. In some implementations, the valve is located in a different position on the inflated object than sensor enclosure 100. In some implementations, the valve can be located on an opposite end of an inflated object from sensor enclosure 100. For example, sensor enclosure 100 can be attached to the "top" of a basketball, while the valve is located essentially or exactly 180 degrees from sensor enclosure 100 at the "bottom" of the basketball. When the valve is exactly 180 degrees from the sensor, enclosure material can be added to and around the value during the manufacturing process to weight balance the constructs (e.g., to offset the added mass of the enclosure, the electronics, and the cap).

In some implementations, sensor enclosure 100 is made integral with an inner bladder of an inflatable object such that main body portion 104 extends into an internal area of the inner bladder. Sensor enclosure 100 can be positioned such that the internal cavity 108 is separated from an internal environment of the inner bladder. This allows a pressure differential between the internal environment of the inner bladder and the internal cavity 108 to be created when the internal cavity 108 is inflated (e.g., to between 7 and 9 psi). The walls of main body portion 104 can be made from a flexible material such that the pressure differential between the internal environment of the inner bladder and the internal cavity 108 can allow the walls of main body portion 104 to flex inward and exert pressure upon battery 110 and circuit board 112.

By allowing pressure from the pressurized internal bladder to be imparted upon main body portion 104, sensor enclosure 100 can allow the internal components, including battery 110 and circuit board 112, to be more securely retained in position within internal cavity 108. Fixing the position of circuit board 112 within sensor enclosure 100 can reduce vibrational noise, or interference that could be detected by the motion sensors included in the circuit board 112. This allows the motion sensors to produce cleaner, more accurate measurements of the motions of the inflated object containing sensor enclosure 100 where the measurements are relatively free of vibrational noise caused by secondary vibrations of the sensor enclosure itself.

In some cases, cap 120 includes aperture 122 that allows the internal cavity 108 to be open to an external environment of an inflatable object to which sensor enclosure 100 is attached or made integral with. This allows the pressure within the internal cavity 108 to equalize with a pressure of the external environment of the inflatable object. When the inner bladder of the inflatable object is pressurized, the pressure difference between the internal pressure of the inner bladder and the pressure of the external environment (which is also the pressure within the internal cavity 108) causes the walls of main body portion 104 to flex inward and impart pressure upon the internal components of sensor enclosure 100 to securely retain them.

In some implementations, sensor enclosure 100 can be attached to or integrated into an inflated object so as not to be located within or so as not to pierce an inner bladder of an inflated object. Sensor enclosure 100 can be attached to an inflated object having an inner bladder such that main body portion 104 extends through an opening in the outer layer of the inflated object but remains external to the inner bladder. This configuration can allow sensor enclosure 100 to remain external to the pressurized environment within the inner bladder when the inner bladder is inflated. As the inner bladder is pressurized, the outer surfaces of the inner bladder can contact the outer surfaces of the main body portion 104 and apply pressure to main body portion 104. In some implementations, main body portion 104 can be made from a flexible or semi-flexible material to allow at least a portion of the pressure imparted by the inner bladder to be applied to the internal components housed within internal cavity 108.

For example, as the internal bladder is inflated, the outer surface of the bladder can press against the outer surfaces of main body portion 104 and apply pressure on the outer surfaces of main body portion 104. Referring to FIGS. 2 and 4, when the pressure applied to the outer surfaces of main body portion 104 increases, one or more walls of main body portion 104 can be pressed inward, causing internal cavity 108 to contract and further causing securing members 115 to apply pressure to battery 110 and circuit board 112 in order to more securely retain battery 110 and circuit board 112 in place than if main body portion 104 were not exposed to external pressure. The compression of the enclosure may intentionally result in a stiffer overall system than when the inflatable is deflated. In some implementations, aperture 122 extending through cap 120 can allow the pressure of internal cavity 108 to be maintained at the same pressure as the external environment, therefore making the pressure imparted by the inner bladder more effective than if the pressure of internal cavity 108 were greater than the pressure of the external environment.

By allowing the inner bladder of an inflated item to impart pressure upon main body portion 104, sensor enclosure 100 can allow the internal components, including battery 110 and circuit board 112, to be more securely retained in position within internal cavity 108. Fixing the position of circuit board 112 within sensor enclosure 100 can reduce vibrational noise, or interference that could be detected by the motion sensors included in the circuit board 112. This allows the motion sensors to produce cleaner, more accurate measurements of the motions of the inflated object containing sensor enclosure 100 where the measurements are relatively free of vibrational noise caused by secondary vibrations of the sensor enclosure itself.

Referring now to FIG. 2, the upper portion of aperture 118 has a diameter 202. Diameter 202 can be within the range of 15 mm and 30 mm (e.g., 15, 16, 18, 18, 19, 20, 21, 22, 23, 24, 25, 26, 27, 28, 29, or 30 mm). In some implementations, diameter 202 can be about 20 mm. In some implementations, diameter 202 can be about 21.675 mm. In some implementations, a diameter of the upper portion of cap 120 corresponds to diameter 202. A middle portion of aperture 118 can have a diameter 203. Diameter 203 can be within the range of 15 mm and 30 mm (e.g., 15, 16, 18, 18, 19, 20, 21, 22, 23, 24, 25, 26, 27, 28, 29, or 30 mm). In some implementations, diameter 203 can be about 20.611 mm. In some implementations, a diameter of the middle portion of cap 120 corresponds to diameter 203.

The bottom portion of internal cavity 108 can have a diameter 204. Diameter 204 can be within the range of 15 mm and 30 mm (e.g., 15, 16, 18, 18, 19, 20, 21, 22, 23, 24, 25, 26, 27, 28, 29, or 30 mm). In some implementations, diameter 204 can be about 23.25 mm. The bottom of sensor enclosure 100 can have a diameter 206. Diameter 206 can be within the range of 15 mm and 30 mm (e.g., 15, 16, 18, 18, 19, 20, 21, 22, 23, 24, 25, 26, 27, 28, 29, or 30 mm). In some implementations, diameter 206 can be about 28 mm. The sensor enclosure can have a height 208. Height 208 can be within the range of 25 mm and 60 mm (e.g., 25, 26, 27, 28, 29, 30, 31, 32, 33, 34, 35, 36, 37, 38, 39, 40, 41, 42, 43, 44, 45, 46, 47, 48, 49, 50, 51, 52, 53, 54, 55, 56, 57, 58, 59, or 60 mm). In some implementations, height 208 can be about 46 mm.

Cap 120 can have a height 210. Height 210 can be within the range of 5 mm and 20 mm (e.g., 5, 6, 7, 8, 9, 10, 11, 12, 13, 14, 15, 16, 18, 18, 19, or 20 mm). In some implementations, height 210 can be about 15 mm. The top portion of cap 120 can have a height 212. Height 212 can be within the range of 0 mm and 10 (e.g., 0, 1, 2, 3, 4, 5, 6, 7, 8, 9, or 10 mm). In some implementations, height 212 can be about 2 mm. The flared bottom portion of cap 120 can have a height 214. Height 214 can be within the range of 0 mm and 6 mm (e.g., 0, 1, 2, 3, 4, 5, or 6 mm). In some implementations, height 214 can be about 3 mm. In some implementations, the height of groove 121 can correspond to height 214.

Extending lip portion 102 can have a height 216. Height 216 can be within the range of 1 mm and 5 mm (e.g., 1, 2, 3, 4, or 5 mm). In some implementations, height 216 can be about 2 mm. Referring to FIG. 1, extending lip portion 102 can have a diameter 218. Diameter 218 can be within the range of 30 mm and 200 mm (e.g., 30, 40, 50, 60, 70, 80, 90, 100, 110, 120, 130, 140, 150, 160, 170, 180, 190, or 200 mm). In some implementations, diameter 218 can be about 70 mm.

In some implementations, sensor enclosure 100 can include a charging port to allow a battery charger to be attached to battery 110 to recharge battery 110. For example, cap 120 can be removed to expose the charging port. As another example, a portion of a battery charger can be inserted through aperture 122 in order to contact the charging port. In some implementations, the charging port can connect to a charger that plugs into a standard wall outlet and receives 125 volt AC power. In other implementations, the charging port can connect to a standard USB computer port to deliver, e.g., 5 volt DC power.

In some cases, a sensor enclosure provided herein can include a valve partially disposed within a bottom surface of a main body portion. For example, an aperture can extend through the bottom of a main body portion of a sensor enclosure. A valve (e.g., a rubber valve for accepting a pumping needle) can be located in or inserted into the aperture and attached to the sensor enclosure. The valve can provide a sealable path from the internal cavity of the sensor enclosure through to an inner bladder of the inflatable object. In some cases, the cap and/or electronic components can be removed such that a standard inflation needle can be used to inflate the inflatable object via the valve located in the internal cavity of the sensor enclosure. In some cases, the valve can be located in alignment with an aperture of a cap (e.g., the aperture 122) such that a needle (e.g., long needle) can be used to inflate the inflatable object without removing the cap and/or electronic components.

Configuring an inflation valve in conjunction with a sensor enclosure provided herein can allow the sensor enclosure to function as both a secure enclosure for retaining electronic components (such as battery 110 and circuit board 112) as well as an air pumping valve for an inflated object. This configuration can alleviate the need for separate openings to be made in the surface of an inflated object.

Figure 5:
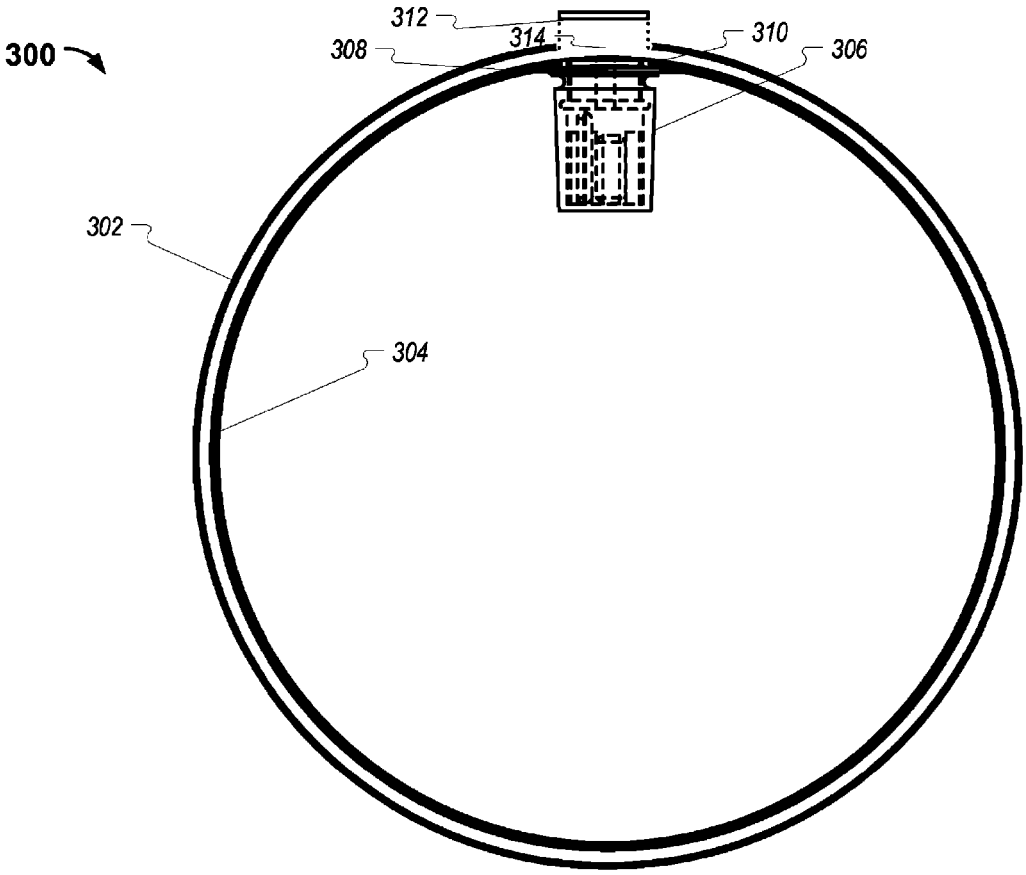
FIG. 5 is a cross sectional view of an inflatable object having an enclosure or a boot structure for securely retaining electronic components.

Referring now to FIG. 5, an inflatable object 300 (e.g., a basketball) can include an outer layer 302 and an inner bladder 304. In some cases, a winding layer (e.g., a winding layer of nylon) can be located between outer layer 302 and inner bladder 304. A sensor enclosure 306 can be affixed to the inflatable object 300. In some implementations, the configuration of sensor enclosure 306 can be substantially similar to the configuration of sensor enclosure 100 shown in FIGS. 1-4. In some implementations, sensor enclosure 306 can have a configuration that is different than the configuration of sensor enclosure 100. Sensor enclosure 306 can securely retain electronic components such as one or more batteries, one or more circuit boards, one or more motion sensors (either included in, or separate from the circuit board), a charging port for receiving a battery charger, and/or wiring for electrically connecting the electronic components retained within sensor enclosure 306.

As described above with respect to sensor enclosure 100, sensor enclosure 306 includes an extending lip portion 308 for engaging inner bladder 304. In the example shown in FIG. 5, an upper surface of extending lip portion 308 engages an inner surface of inflatable object 300. In some cases, the material of the inner bladder and the material of all or a portion of extending lip portion 308 can be treated (e.g., vulcanized) to form an integral unit. In some cases, extending lip portion 308 can be affixed to inner bladder 304 using an adhesive such as rubber cement or two-part epoxy.

In some implementations, sensor enclosure 306 is attached to inner bladder 304 such that a portion of sensor enclosure 306 extends through an aperture 310 in inner bladder 304 and an upper surface of sensor enclosure 306 is flush or nearly flush with an outer surface of the inner bladder 304. In some such implementations, inflatable object 300 can include a cap 312 (e.g., separate from a cap of sensor enclosure 306) that fits into an aperture 314 in outer layer 302. Cap 312 can be inserted into aperture 314 to form a smooth, continuous surface with outer layer 302, while allowing access to sensor enclosure 306. For example, cap 312 can be removed to allow access to a charging port of sensor enclosure 306. Sensor enclosure 306 can include, for example, a cap (separate from cap 312, having an aperture that extends through the cap. In some cases, cap 312 can define an opening that can be positioned to align with an opening present in a cap that fits within sensor enclosure 306. The alignment of such openings can allow a user to insert a wire connection for charging a battery located within sensor enclosure 306. In some cases, cap 312 can be removed from inflatable object 300 in order to expose the aperture and allow a battery charger to be inserted into the aperture to engage with a charging port of sensor enclosure 306.

In some implementations, cap 312 can be constructed from rubber, flexible or semi-flexible plastic, leather, or composite leather (e.g., synthetic leather). In some implementations, cap 312 is constructed from the same material as outer layer 302. In some implementations, cap 312 is held in place within aperture 314 by a friction fit. In some implementations, cap 312 and aperture 314 can be threaded to allow cap 312 to be screwed onto inflatable object 300.

In some implementations, a portion of sensor enclosure 306 can extend through aperture 310 and aperture 314 such that an upper surface of sensor enclosure 306 is flush or nearly flush with the outer surface of outer layer 302. In some implementations, extending lip portion 308 can be affixed to an outer surface of inner bladder 304. In some implementations, extending lip portion 308 can be affixed to an inner or outer surface of outer layer 302.

Figure 8:
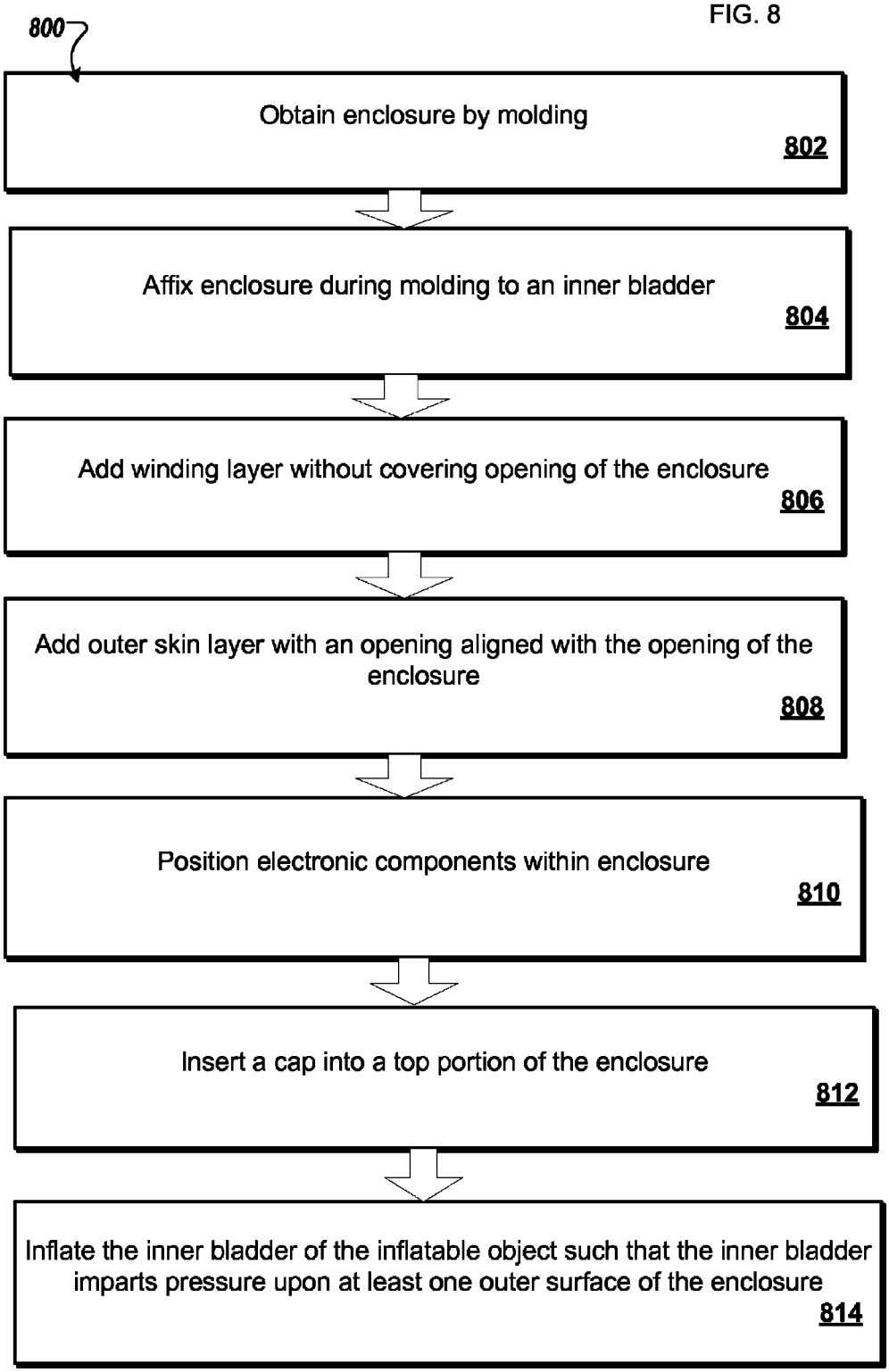
FIG. 8 is a flow chart of an example method of use for an enclosure for securely retaining electronic components.

Referring now to FIG. 8, a method of use 800 for an enclosure for securely retaining electronic components includes, without limitation, a step 802 of obtaining an enclosure. Such an enclosure can be obtained by molding the enclosure as a separate item. At step 804, the enclosure can be affixed to an inner bladder. For example, the enclosure can be made integral with the inner bladder of the inflatable object during a molding process used to produce the inner bladder. In some cases, the material of the inner bladder and the material of all or a portion of the enclosure can be treated (e.g., vulcanized) to form an integral unit.

In some cases, the enclosure can include a flared portion that extends radially outward from a main body of the enclosure. In some implementations, the flared portion can engage an inner surface of the inner bladder with a main body of the enclosure extending into the inner bladder, and a top portion of the enclosure extending through an aperture in the inner bladder. In some implementations, the flared portion can fit over an outer surface of the inner bladder while a main body of the enclosure extends into an inner portion of the internal bladder. In some cases, the material of the inflatable object around the opening and the material of the flared portion of the enclosure can be treated (e.g., vulcanized) such that a continuous flow of material is created and the enclosure becomes integral with the inflatable object.

In some cases, the interior of the inner bladder can be separated from an external environment of the inflatable object to allow the inner bladder to have an internal pressure that is different from a pressure of the external environment. The enclosure can be positioned with respect to the inner bladder such that an internal cavity of the enclosure is separated from an internal environment of the inner bladder when the enclosure affixed to the internal bladder. The inflatable object can be, for example, a basketball, volleyball, football, soccer ball, or inflatable punching bag.

In some implementations, a seal is formed between an extending lip portion of the enclosure and the outer surface of the inner bladder. For example, the extending lip portion can be affixed to the inner bladder using an adhesive, such as, for example, an epoxy resin. As another example, a vacuum seal can be formed between the extending lip portion and the inner bladder. As yet another example, a friction seal can be formed between the extending lip and the inner bladder.

In some implementations, the enclosure is positioned such that a top portion of the enclosure extends through an opening in an outer layer of the inflatable object. For example, the outer layer of the inflatable object can include an opening there through. An upper portion of the enclosure can be positioned within the opening such that a top surface of the enclosure is exposed to an external environment of the inflatable object. In some implementations, a top surface of the enclosure is flush or nearly flush with an outer surface of the outer layer. In some implementations, the enclosure includes a cap inserted in the top portion and a top surface of the cap is flush or nearly flush with the outer surface of the outer layer. In some implementations, the cap can be removed to allow external access to components positioned within an internal cavity of the enclosure.

At step 806, a winding layer can be added over the inner bladder. Application of the winding layer can be performed such that the windings do not cover the opening of the enclosure. At step 808, an outer skin layer can be added over the winding layer. Application of the outer skin layer can be performed such that the outer skin layer does not cover the opening of the enclosure. At step 810, electronic components can be positioned within the enclosure in a secure manner. For example, an internal cavity of the enclosure can include one or more receiving slots for receiving various electronic components. The components can be inserted into the receiving slots. In some implementations, foam or other materials can be used as securing members for separating various electronic components and securing the electronic components in place. In some implementations, the securing members can have shock absorbing characteristics for absorbing movements imparted upon the enclosure. The electronic components can include one or more batteries, one or more circuit boards, or one or more sensors. The sensors can, for example, be motion sensors (e.g., accelerometers, angular rate gyros, and magnetometers) for detecting motions of an inflatable object having the enclosure. As another example, the sensors can be temperature or pressure sensors. In some implementations, the sensors can be included as part of a circuit board.

At step 812, a cap can be inserted into a top portion of the enclosure. For example, a rubber stopper type cap can be inserted into an aperture disposed within the top of the enclosure. The cap can be secured via a friction fit, or a pop-in type fit. In some cases, the cap can be secured via an adhesive such as rubber cement or two-part epoxy. The cap can be designed to provide a smooth surface to the inflatable object in the area of the sensor enclosure. In some implementations, the cap can include an opening to allow air to flow between an internal cavity of the enclosure (e.g., a cavity that retains the electronic components) and an external environment of the enclosure. The opening can allow the air pressure within the enclosure to equalize with an external air pressure.

At step 814, the inner bladder of the inflatable object can be inflated such that pressure is imparted upon at least one outer surface of the enclosure. For example, the inner bladder can be inflated until the internal pressure of the inner bladder exceeds a pressure of an internal cavity of the enclosure. The pressure imparted by the internal environment of the inner bladder onto the enclosure can cause the internal cavity to contract, thereby retaining the electronic components more securely within the enclosure. The additional pressure imparted by the inner bladder upon the enclosure can stiffen the enclosure which can lead to reduced vibrational noise, or interference that could be detected by motion sensors retained within the enclosure. This allows the motion sensors to produce cleaner, more accurate measurements of the motions of the inflatable object where the measurements are relatively free of vibrational noise caused by secondary vibrations of the enclosure.

In some embodiments of the method of use 800, more or fewer steps can be performed, or steps can be performed in a different order. For example, the step of inserting a cap into a top portion of the enclosure can be performed after the step of affixing the enclosure to an inner bladder of an inflatable object. As another example, the method of use 800 can additionally include a step of recording motion data related to movements of the inflatable object using sensors retained within the enclosure.

A number of embodiments of the invention have been described. Nevertheless, it will be understood that various modifications may be made without departing from the spirit and scope of the invention. Accordingly, other embodiments are within the scope of the following claims.

What is claimed is:

1. A standard full-size or mid-size basketball comprising:

(a) an inner compartment to be inflated with air, (b) an inflation valve for allowing inflation of said inner compartment with air, (c) a pocket compartment comprising an extending lip portion and a main body portion and defining an inner cavity configured to house a rechargeable battery and motion sensors selected from the group consisting of angular rate gyros and magnetometers, wherein said pocket compartment is positioned within said basketball off-set from the center of said basketball, wherein air inflated into said inner compartment is isolated from said inner cavity of said pocket compartment, wherein said pocket compartment comprises a groove located beneath said extending lip portion and extending around said main body portion, wherein said groove reduces transfer of vibrations from an outer surface of said basketball to said motion sensors when said inner compartment is inflated with air, (d) said rechargeable battery located within said inner cavity, (e) said motion sensors located within said inner cavity, wherein said motion sensors are configured to measure angular velocity of said basketball, and (f) a securing member located within said inner cavity, wherein said securing member is configured to secure said rechargeable battery or said motion sensors in place within said inner cavity, wherein at least a portion of said pocket compartment is flexible such that inflation of said inner compartment with air causes said portion of said pocket compartment to flex, and wherein the flexed portion of said pocket compartment increases a compression force against said battery and motion sensors, thereby reducing the possibility that said battery and motion sensors move within said inner cavity relative to said pocket compartment.

2. The basketball of claim 1, wherein said inner cavity is open to external air.

3. The basketball of claim 1, wherein at least a portion of said pocket compartment is flexible such that inflation of said inner compartment with air causes said portion of said pocket compartment to flex.

4. The basketball of claim 1, wherein said pocket compartment is flexible.

5. The basketball of claim 4, wherein inflation of said inner compartment with air causes said flexible pocket compartment to compress against said battery and motion sensors.

6. The basketball of claim 5, wherein inflation of said inner compartment with air causes said flexible pocket compartment to stiffen, thereby reducing vibrational noise detectable by said motion sensors.

7. The basketball of claim 1, wherein said basketball is a standard full-size basketball.

8. The basketball of claim 1, wherein said pocket compartment comprises a body portion having flexible walls configured to exert an inward pressure directly on said battery and motion sensors, when said inner compartment is inflated.

9. The basketball of claim 1, wherein said pocket compartment comprises a body portion having flexible walls configured to exert an inward pressure indirectly on said battery and motion sensors, when said inner compartment is inflated.

10. The basketball of claim 1, wherein said pocket compartment comprises a removable cap.

11. The basketball of claim 7, wherein said removable cap defines a hole.

12. The basketball of claim 7, wherein said removable cap defines a hole to provide said inner cavity with an opening to external air.

13. The basketball of claim 1, wherein said basketball comprises a circuit board comprising said motion sensors.

14. The basketball of claim 1, wherein said basketball is a mid-size basketball.

15. The basketball of claim 1, wherein said inner cavity is open to external air pressure without compromising the pressure of the inner compartment.

16. The basketball of claim 1, wherein said pocket compartment is located within said basketball opposite from said inflation valve.

17. The basketball of claim 1, wherein said pocket compartment is located within said basketball essentially or exactly 180 degrees from said inflation valve.

18. The basketball of claim 1, wherein the height of said pocket compartment is from 25 mm to 60 mm in length.

* * * * *